United States Patent [19]

Bousquet et al.

[11] 4,106,899

[45] Aug. 15, 1978

[54] TEXTILE GOODS BLEACHING MEANS AND METHOD

[75] Inventors: Donald G. Bousquet, Gastonia; Jesse G. Camp, Jr.; Mortimer Gilbert Hopkins, both of Charlotte; Leonard J. Jagt, Belmont, all of N.C.

[73] Assignee: Gaston County Dyeing Machine Company, Stanley, N.C.

[21] Appl. No.: 760,729

[22] Filed: Jan. 19, 1977

[51] Int. Cl.[2] ..... D06L 3/14

[52] U.S. Cl. ..... 8/101; 8/111; 8/151; 8/158

[58] Field of Search ..... 8/101, 111, 151, 158

[56] References Cited

U.S. PATENT DOCUMENTS

| | | | |
|---|---|---|---|
| 2,334,066 | 11/1943 | Campbell et al. | 8/111 |
| 3,026,166 | 3/1962 | Gallagher et al. | 8/111 |
| 3,030,171 | 4/1962 | Lindsay | 8/111 |
| 3,554,685 | 1/1971 | Stalter et al. | 8/111 |

OTHER PUBLICATIONS

Chemical Treatment & Finishing, Textile World, Jul. 1962, pp. 220–233.

*Primary Examiner*—John Kight, III

*Attorney, Agent, or Firm*—Richards, Shefte & Pinckney

[57] ABSTRACT

An improved arrangement and method for bleaching textile goods is provided wherein a J-box is employed for storing the goods transiently for the bleach while allowing the travel of the stored goods to shut down whenever desired while leaving the goods in place without damage.

2 Claims, 2 Drawing Figures

TEXTILE GOODS BLEACHING MEANS AND METHOD

BACKGROUND OF THE INVENTION

Cotton and cotton blend knit goods are commonly bleached with an alkaline hydrogen peroxide solution in a range which first saturates the goods with bleaching liquor, then heating the saturated goods by steaming and transiently storing the goods in a J-box while retaining the heat applied by steaming for a sufficient bleaching period. Prior U.S. Pats. No. 2,334,066 and No. 2,858,184 contain representative disclosures of such processing.

More recently systems have been developed in which the bleaching liquor was applied in the heel of the J-box while steaming in the straight leg of J-box below the piling level therein. Both of these systems, however, have involved troublesome disadvantages. Where the goods are saturated first and then steamed it has not been possible to stop the process without emptying the J-box because tendering of the goods results if this is not done, while when the bleaching liquor is applied at the heel of the J-box a constant poundage of throughput must be maintained in order to keep the J-box piling high enough in the straight leg of the J-box for steaming and steaming of the J-box pile has tended to yield non-uniform results.

The present invention eliminates these disadvantages.

SUMMARY OF THE INVENTION

According to the present invention the goods are first saturated with bleaching liquor and then fed to the J-box for steaming prior to piling therein, while additional heated bleaching liquor is maintained flowing through the heel of the J-box during processing, but means is provided whenever the feed of goods is to be interrupted to stop the steaming and redirecting the heel flow of bleaching liquor for unheated flow throughout the J-box pile of goods so that the bleaching action is discontinued, as described further below in connection with the accompanying drawings.

DETAILED DESCRIPTION OF THE INVENTION

Figure 1:
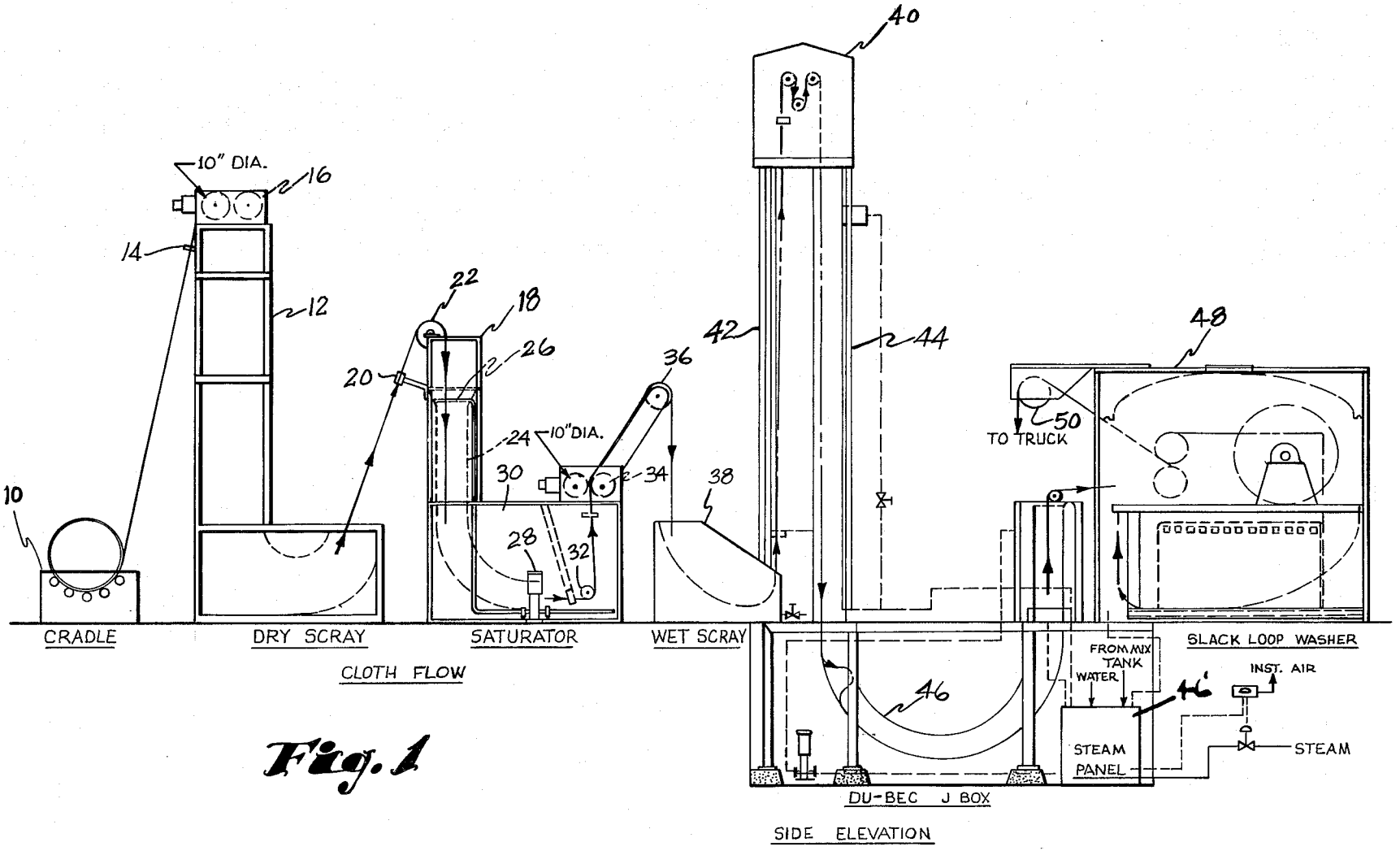
FIG. 1 is a schematic side elevation of a bleaching range embodying the present invention.

Referring just to FIG. 1 of the drawings, the illustrated bleaching range is seen a cradle 10 from which a roll of greige goods to be bleached is fed to a dry scray 12 through a poteye 14 to rope the goods and through a pair of draw rolls 16 for accumulation ahead of a saturator 18. The roped goods enters the saturator through another poteye 20 and over driven reel 22 to an entering J-chute 24. Adjacent the top of the J-cute 24 a spray ring at 26 is fed from a recirculating system 28 running from the bottom of a bleaching liquor tub 30 to provide thorough penetration of the goods being treated as they enter the J-chute 24. The goods emerge from the J-chute 24 under an immersion roll 32 from which it is directed upwardly through a pair of squeeze rolls 34 and over an unloading doffer 36 to a wet scray 38 which accumulates the saturated goods for feed through the J-box 40.

The J-box includes a downwardly extending entry leg 42 having a poteye 42' at its bottom and at the top of which a three-roll cluster is arranged for pulling the goods upwardly and transferring them into the adjacent straight leg 44 of the J-box proper in which the goods are piled for progress ultimately through the curved bottom heel portion 46 from which the goods are led to a SLACK LOOP WASHER 48 and exits over a doffing roll 50 to a suitable truck or other receptacle to be conveyed for further processing.

Figure 2:
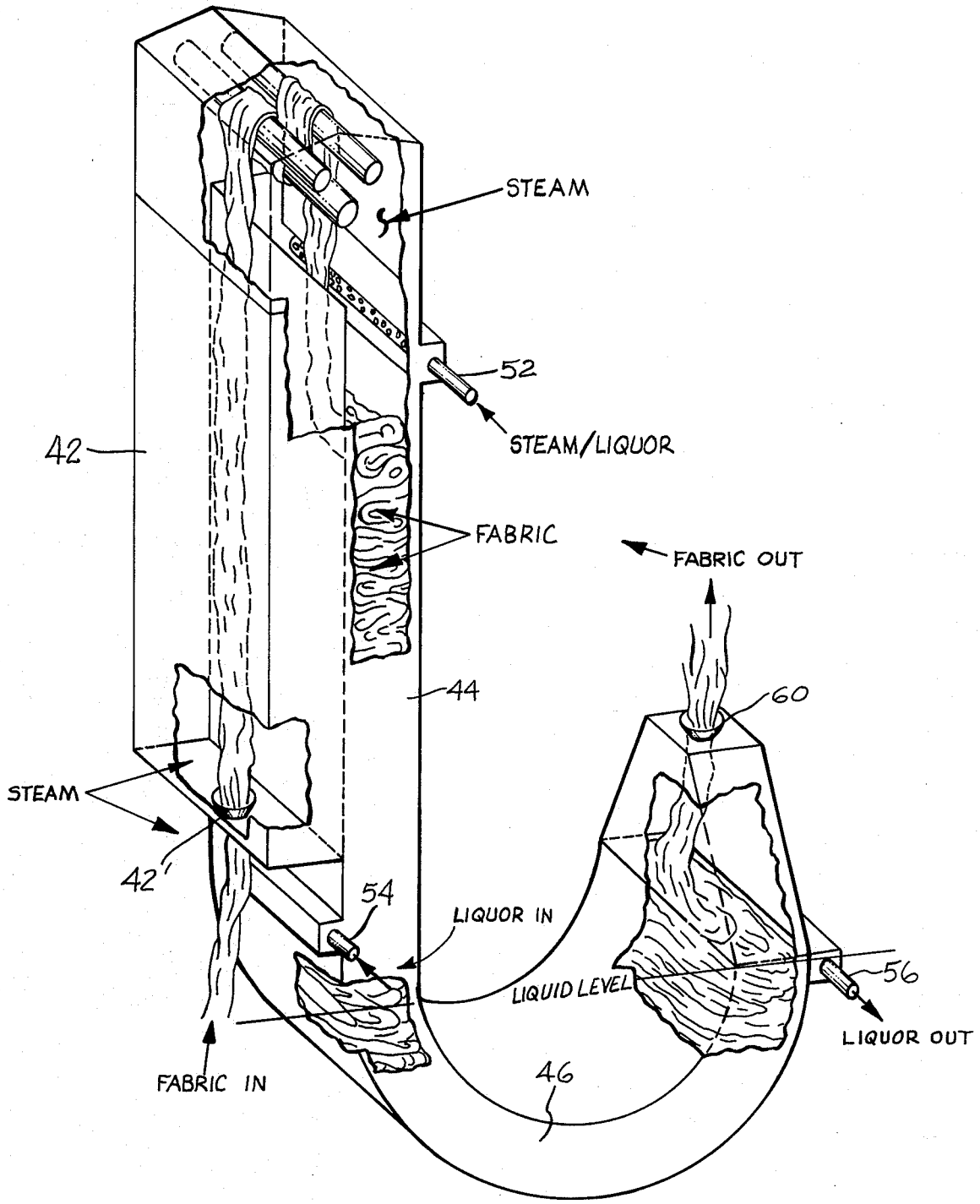
FIG. 2 is a perspective illustration of the J-box arrangement.

The arrangement of the J-box 40 is indicated best in FIG. 2 of the drawings in which an inlet pipe is shown at 52 adjacent the top of the straight J-box leg for introducing steam above the piling point of the goods therein for heating the goods in the range of 140° to 212° F. during travel upwardly in the entry leg 42 and prior to piling in the straight leg storage portion. The steam enters the J-box 40 at the inlet 52 and flows counter-currently to the goods through the entry leg 42 and exits at a poteye at the bottom of this entry leg 42 through which the entering goods are trained.

The heated goods then progress downwardly in piled form through a major portion of the straight J-box leg 44 to the curved bottom heel portion at which further bleaching liquor is added through an inlet at 54 and exits through an outlet at 56 just before the goods are lifted out of the J-box 40 through a discharge poteye 60 for transfer to a SLACK LOOP WASHER 48. The further bleaching liquor is recirculated from a tank at 46' which incorporates a steam panel for indirect heating for the heel recirculation.

In operation, the goods pass through the range so as to leave with a 100% pick-up of bleaching liquor at the saturator squeeze rolls 34 and are pulled into the entry leg 42 of J-box 40 for uniform steaming that brings the goods up to bleaching temperature before being piled in the straight J-box leg 44 and this temperature is maintained by the recirculation provided in the J-box heel portion 46. Whenever the operation must be interrupted, however, as at the end of a shift the heel recirculation is redirected to the steaming point 52 and the liquor heat is shut off as well as the steaming so that the bleaching liquor is circulated throughout the J-box piled storage but at a temperature below that at which bleaching takes place so that tendering of the goods standing in the J-box 40 is avoided. As the J-box 40 is sized to contain 3,000 pounds or more of goods a good deal of time is saved in being able simply to shut it down whenever necessary without having to remove the goods first. With the arrangement of the present invention it is only necessary to begin preliminary steaming again and heated heel recirculation in order to start up the range again.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. In a bleaching range for textile goods in which the goods are first saturated with a bleaching liquor and then fed to a J-box for preliminary steaming and subsequent further treatment with the bleaching liquor in the heel of the J-box, the improvement which comprises means for steaming the saturated goods within the J-box prior to piling of the goods therein, means for maintaining a flow of heated bleaching liquor through the goods in the heel of the J-box, and means for stopping the steaming and redirecting the flow of bleaching liquor to the steaming point for unheated flow throughout the J-box pile of goods whenever the feed of goods through the J-box is interrupted.

2. The method of bleaching textile goods in which the goods are first saturated with a bleaching liquor and then fed to a J-box for preliminary steaming and subsequent further treatment with bleaching liquor in the heel of the J-box, which comprises steaming the saturated goods within the J-box prior to piling of the goods therein, maintaining a flow of heated bleaching liquor through the goods in the heel of the J-box, and stopping the steaming and redirecting the flow of bleaching liquor to the steaming point for unheated flow throughout the J-box pile of goods whenever the feed of goods through the J-box is interrupted.

* * * * *